US010010463B1

(12) United States Patent
King

(10) Patent No.: US 10,010,463 B1
(45) Date of Patent: Jul. 3, 2018

(54) BED BATH ARTICLE

(71) Applicant: Jonathan Brice King, Hideaway, TX (US)

(72) Inventor: Jonathan Brice King, Hideaway, TX (US)

( * ) Notice: Subject to any disclaimer, the term of this patent is extended or adjusted under 35 U.S.C. 154(b) by 63 days.

(21) Appl. No.: 15/173,639

(22) Filed: Jun. 4, 2016

Related U.S. Application Data

(60) Provisional application No. 62/172,172, filed on Jun. 7, 2015.

(51) Int. Cl.

| | |
|---|---|
| ***A47K 3/06*** | (2006.01) |
| ***A61G 7/00*** | (2006.01) |
| ***A61G 7/05*** | (2006.01) |
| ***A47K 3/062*** | (2006.01) |
| ***E03C 1/22*** | (2006.01) |

(52) U.S. Cl.
CPC ..... *A61G 7/0005* (2013.01); *A47K 3/062* (2013.01); *A61G 7/0507* (2013.01); *E03C 1/22* (2013.01)

(58) Field of Classification Search
USPC ..... 4/585, 491; 5/507.1, 503.1
See application file for complete search history.

(56) References Cited

U.S. PATENT DOCUMENTS

| | | | | |
|---|---|---|---|---|
| 3,803,642 | A * | 4/1974 | Erling | A61G 7/0005 4/587 |
| 4,713,850 | A * | 12/1987 | Flaherty | A47K 3/06 4/585 |
| 4,890,343 | A * | 1/1990 | Schlags | A47K 3/286 220/62 |
| 5,085,212 | A * | 2/1992 | DeCosta | E04H 15/003 4/526 |
| 5,498,455 | A * | 3/1996 | Roberts | A47G 1/175 40/773 |
| 5,778,590 | A * | 7/1998 | Browning | B32B 27/08 42/96 |
| 2006/0282944 | A1* | 12/2006 | Sagi | A61G 7/0005 4/585 |
| 2011/0083262 | A1* | 4/2011 | Barba | A47K 3/06 4/585 |

FOREIGN PATENT DOCUMENTS

| | | |
|---|---|---|
| EP | 2213271 A1 | 8/2010 |

* cited by examiner

*Primary Examiner* — Lauren Crane
(74) *Attorney, Agent, or Firm* — Jeffrey Roddy

(57) ABSTRACT

A collapsible bed bath article which is erectable over the mattress of a hospital-style bed and provides a water impervious enclosure having a drain for rinsing a bed bound patient. In one embodiment, side panels of the article are equipped with pockets which are configured to fit over portions of raised side rails of a hospital-style bed. In another embodiment, a pocket for a side rail of a bed may be produced on an ad hoc basis by adhering portions of each side panel to itself, or to the side rail, thus forming a partial encapsulation of the bed side rail.

19 Claims, 11 Drawing Sheets

100

3
3
105
105
107
107
104a
103a
103b
102a
102b
102c
101
102c
4
4
107
107
104b
105
105
112

BED BATH ARTICLE

CROSS-REFERENCE TO RELATED APPLICATIONS

This Non-Provisional Application claims the benefit of U.S. Provisional Application No. 62/172,172 titled "Disposable Bed-based Bathing Apparatus and Cleansing Basin" and having a filing date of Jun. 6, 2015.

FIELD OF THE INVENTION

The present invention relates to articles for the care of patients and residents of a health care facility and disabled persons, and more specifically to the regular bathing needs of same when performed by a care provider.

BACKGROUND OF THE ART

A difficult requirement of patient care is bathing a bed bound patient. Though many devices have been created to assist a care provider in delivering a bathing experience to an immobile patient, none have replaced the traditional yet utterly ineffective method of wiping a patient with a wet, soapy rag. As in-patient hospital infection rates increase and prolonged hospital stays result in unrecoverable health care costs, a new, efficient, economical solution is needed. A problem arises, however, when the solution is more complicated and costly than the problem it is intended to solve. Some past attempts to solve the problem of efficient bed bathing for inpatients have produced bulky assemblies intended for reuse that are awkward to assemble, or require costly disinfection between patients. Many attempts to solve the problem of cleaning the bed bound patient require filling a surrounding enclosure with water. Many patients cannot tolerate partial immersion due to invasive devices or orthopedic devices that may degrade or malfunction if submerged. Furthermore, soaking or submerging surgical wounds in water poses a significant problem because they can become unstable and reopen. Accumulated bath water increases the likelihood that localized bacteria may migrate to other parts of the body. While there are many devices available for use with bed-ridden patients, none offer all the long felt needs in patient care, and none truly address the issue of providing a cost-effective, thorough, and complete bathing experience for a bed bound patient.

It would be desirable to provide a bed bath article that meets the safety needs of the patient and caregivers.

It would be further desirable to provide a bed bath article that is easy to maneuver beneath a bed bound patient.

It would be further desirable to provide a bed bath article that requires little or no assembly prior to use.

It would be still further desirable to provide a bed bath article that leverages existing bed structures for support.

SUMMARY

In an aspect of one general embodiment, a bed bath article includes a compact package that when unfolded provides an enclosure for bathing a bed bound patient. Materials employed in the bed bath article construction are thin and flexible enough to maneuver beneath a patient without risking damage to the patient's skin integrity. More specifically, the bed bath article is a construction of flexible plastic sheet or plastic film composite construction and includes a bottom panel, a drain, a drain tube and at least four raisable panels at sides of the bottom panel for fluid containment purposes. The at least four raisable panels include at least two side panels and at least two end panels that are elevated around the patient to form a bathing enclosure. In order to use the bed bath article, the bottom panel is maneuvered beneath the patient and the at least two side panels are then uprightly supported using raised bed side rails of a hospital-style bed, thereby tensioning the end panels transversely therebetween and forming an enclosure configured for safely bathing the patient.

In some implementations, the side panels include pockets that are configured for placement over the raised bed side rails of a hospital-style bed.

In some implementations, the side panels and the at least two end panels are welded, sealed, molded or otherwise connected at a juncture to form a gapless seam.

In some implementations, the end panels may possess increased rigidity provided by a relatively stiff light-weight member; e.g., a card board panel inserted into a pocket on each end panel or adhered to outer surfaces; i.e., surfaces not subject to wetting, of each end panel.

In some implementations, the bottom panel of the bed bath article is substantially rectangular, and the side panels and the end panels are joined at corners.

In some implementations, the end panels are shorter than the side panels.

In some implementations, the drain tube may be a flexible hose that may be folded or securely kinked to control the flow of fluid.

In some implementations, portions of the drain tube may be adhered or otherwise reversibly attached to a side panel or an end panel, by means of snap fasteners, hook and loop fasteners, elastic bands, tethers, adhesives, loop fasteners, button fasteners or any fastening means to secure the drain tube to portions of the bed bath article that would suggest itself to a person having ordinary skill in the art.

In some embodiments, the side panels may include one or more pockets each.

In some embodiments, the side panels may include light-tack adhesive; e.g., peel away strips over an applied light-tack adhesive band, to enable the side panels to non-destructively adhere to the bed side rails of a hospital-style bed.

In some embodiments, the end panels may include light-tack adhesive; e.g., peel away strips over an applied light-tack adhesive band, to enable the end panels to non-destructively adhere to the headboard and footboard of a hospital-style bed. In some embodiments, an adhesive band may be attached to one or more side panels and configured to span areas of hospital-style side rails otherwise uncovered. In such cases, the adhesive band may be drawn from a side panel and connected to an end panel in order to increase tautness of the end panel.

In some embodiments, the bed bath article may include more than one drain and drain tube. While in the embodiments depicted, a drain is shown in one corner of the bottom panel, one or more drains may be positioned on one or more side panels adjacent the bottom panel.

In some embodiments, the side panels may include one or more regions or strips of light-tack adhesive which may extend from one end of a hospital-style bed to an opposite end, thereby providing additional support for the side panels; e.g., the light-tack adhesive of a side panel may be adhered to one or more bed side rails of the hospital-style bed, or to a bed side rail and a headboard, or, to a bed side rail and footboard, the adhered portions of the side panel providing tautness to the structure.

In some embodiments, adhesive tabs or strips may extend from portions of the bed bath article to adhere to portions; e.g., bed side rails.

In some embodiments, a stiffener may be inserted into one or more pockets of the side panels or adhered to portions of the side panels.

In some embodiments, the bed bath article may be configured to conform to a mattress of a hospital-style bed in a fashion similar to that of a fitted sheet, such that when desired, bed linens can be removed, and the side panels and end panels of the bed bath article can be inverted, i.e., flipped upward, forming sides of a bathing enclosure. In such an embodiment, the panels of the bed bath article may be (1) disinfected and dried after use, (2) turned down and under a mattress, and (3) linens such as a fitted sheet and flat sheet placed over the bed bath article to serve as a moisture barrier to prevent soiling of the mattress surfaces.

Common to all embodiments, the bottom panel of the bed bath article is of sufficient length so that a patient's head and feet do not encounter the end panels when installing the bottom panel beneath the patient.

Common to all embodiments, once the bed bath article is in place and all panels are secured, a bed bound patient can be bathed by a caregiver. Waste water and debris are rinsed down the drain, through the drain tube and into an appropriate waste receptacle. Once the bath is complete, the bed bath article may be removed and disposed of in an appropriate manner.

Advantages

Among the several advantages of one or more aspects of the bed bath article are to provide an inexpensive, lightweight, disposable article enabling a more thorough bathing of a bed bound patient in the hospital setting. By utilizing the hospital bed's side safety rail, stability is added to the device without sacrificing patient safety. The bed bath article is most advantageous to patient care because it allows the care provider to control the bathing process by rinsing the patient instead of soaking. Rinsing the patient ensures that infectious agents are readily removed from the patient and disposed of properly. Additionally, the care provider can pay particular care to wash sensitive areas more thoroughly without causing unnecessary discomfort to the patient. The bed bath article is packaged compactly and may be easily stored on the shelf of a unit supply room.

It will be appreciated by those of ordinary skill in the art that the bed bath article may be constructed by stamping, molding, blow molding, gluing, sonic welding or by any suitable manufacture. The construction can be a single film or plastic sheet, multiple conjoined plastic sheets, or, laminated plastic sheet or film.

The foregoing and other objects, features, and advantages of the invention will become more apparent from the following detailed description, which proceeds with reference to the accompanying figures wherein the scale depicted is approximate.

REFERENCE LISTING

Figure 1:
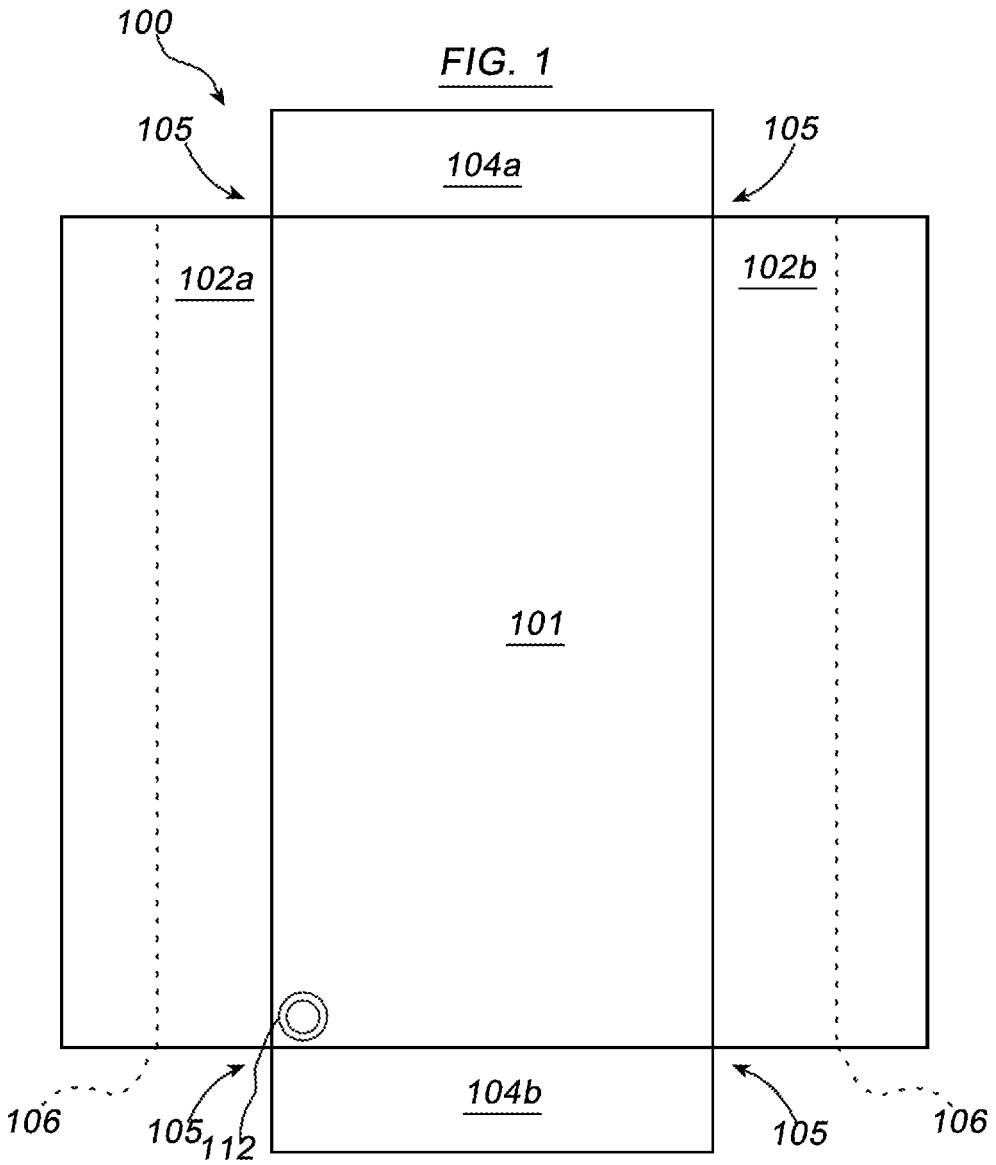
FIG. 1 is a plan view of a first embodiment of a bed bath article according to the present invention, shown with normally conjoined corners 105 mitered, flattened and separated for purposes of structural clarification.

100 bed bath article
101 bottom panel
102*a*, 102*b* side panels
103*a*, 103*b* pockets
104*a*, 104*b* end panels
105 corner
106 fold line
107 pocket seal
108 adhesive strip
109 seam
110 side flap
111 stiffener
112 drain
113 end flap
114 drain tube
115 adhesive band
116 drain control
118 drain fastener
119 pouch
120 wastewater receptacle

200 hospital-style bed
202*a*, 202*b* side rails
204 headboard
206 footboard
208 mattress
310 patient
312 care provider

DETAILED DESCRIPTION OF THE INVENTION

In the following description, the terms "article" and "bed bath article" are used interchangeably. The term "raisable" refers to any portion of the bed bath article which may be raised from a collapsed or folded state and supported in a raised position. The term "insert" refers to any item or article inserted onto or into a portion of the bed bath article. The term "panel" refers to a portion of the bed bath article which is distinguished by structure or function from adjacent structures; erg., a single panel may possess one or more sub-panels. When referring to construction of the bed bath article, the terms "sheet" and "film" are used interchangeably. The term "hospital-style" refers to beds that possess one or more side rails that may be raised and lowered. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. Objects, aspects or features of any embodiment described herein may be combined with any object, aspect or feature of another embodiment described herein. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-29, a bed bath article 100 includes a bottom panel 101, end panels 104*a*, 104*b*, and side panels 102*a*, 102*b* each having a pocket 103*a*, 103*b* configured to receive portions of a hospital-style bed 200 side rail 202*a*, 202*b*, which provides support for the side panels 102*a*, 102*b* of the bed bath article and thereby support for the entire bed bath article 100 with the end panels 102*a*, 102*b* of the article tensioned and transversely supported between the side panels. The bed bath article may be made of a uniform thickness of plastic film or sheeting, or end panels 104*a*, 104*b* may be comparatively stiff; e.g., made of plastic sheeting; e.g., 6-8 mil and substantially self supporting. Alternately, end panels 104*a*, 104*b* may include a stiffener 111 made of cardboard, a plastic panel, or the like, adhered to the end panels or placed in a cavity of an end panel to provide stiffening. End panels 104*a*, 104*b* may include an end flap 113 configured to drape over the headboard and footboard of the hospital-style bed. The end panels may include a channel through which an elastic cord, such as a bungee cord is threaded, with ends of the cord secured to side rails of the hospital-style bed, thereby supporting the end panels. At least one drain 112, is located adjacent an inside corner 105 of the article for draining wastewater. A drain tube 114 connected to the drain may empty into a wastewater receptacle 120 such as a bucket placed beneath the drain.

Referring to FIG. 1, pockets 103*a*, 103*b* of the side panels 102*a*, 102*b* may be of any practical depth, but preferably only that depth required to uprightly secure the side panels to the side rails of a particular make of bed. It should be understood that the 90° mitered corners depicted in FIGS. 1, 2, 6 and 9 is merely a convention to aid in understanding the construction of the article prior to corner seam welding between the panels. Accordingly, the angle of the corners 105 between the side panels and end panels may vary. Corners 105 are conjoined during manufacture by heat sealing or other means previously described.

Figure 2:
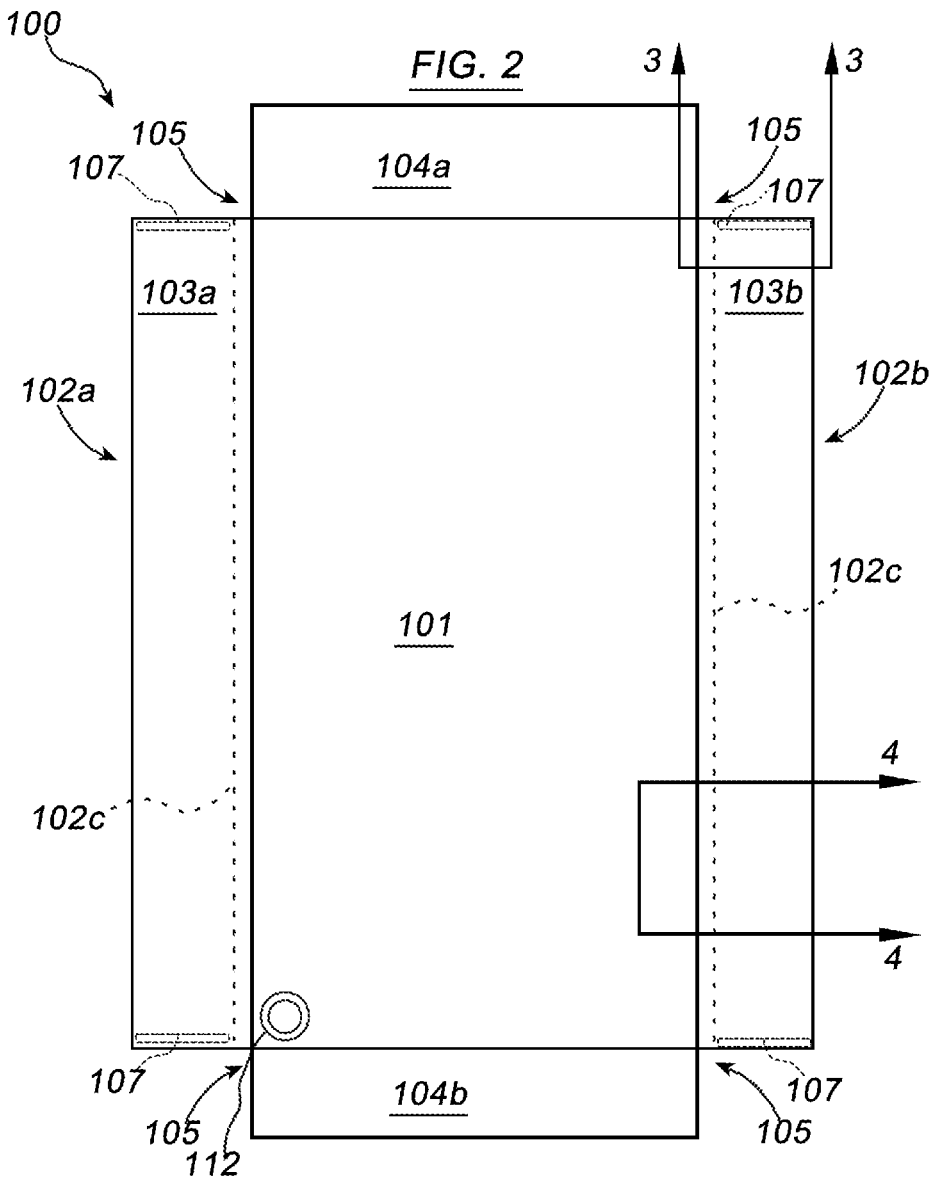
FIG. 2 is a second plan view of the embodiment of (FIG. 1) wherein portions of side panels 102*a*, 102*b* are folded to form pockets 103*a*, 103*b;*
Figure 3:
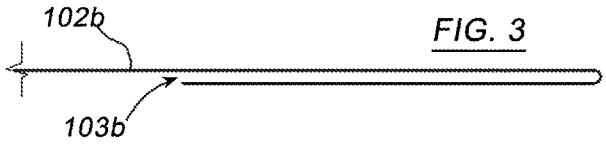
FIG. 3 is a cross-sectional view of (FIG. 2) taken along lines 3-3.
Figure 4:
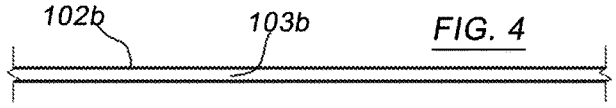
FIG. 4 is a cross-sectional view of (FIG. 2) taken along lines 4-4.

FIG. 2 shows side panels 102*a*, 102*b* with pockets 103*a*, 103*b*. Borders of the pockets are attached to the side panels at seal 107 by heat sealing, gluing or other suitable process.

Figure 5:
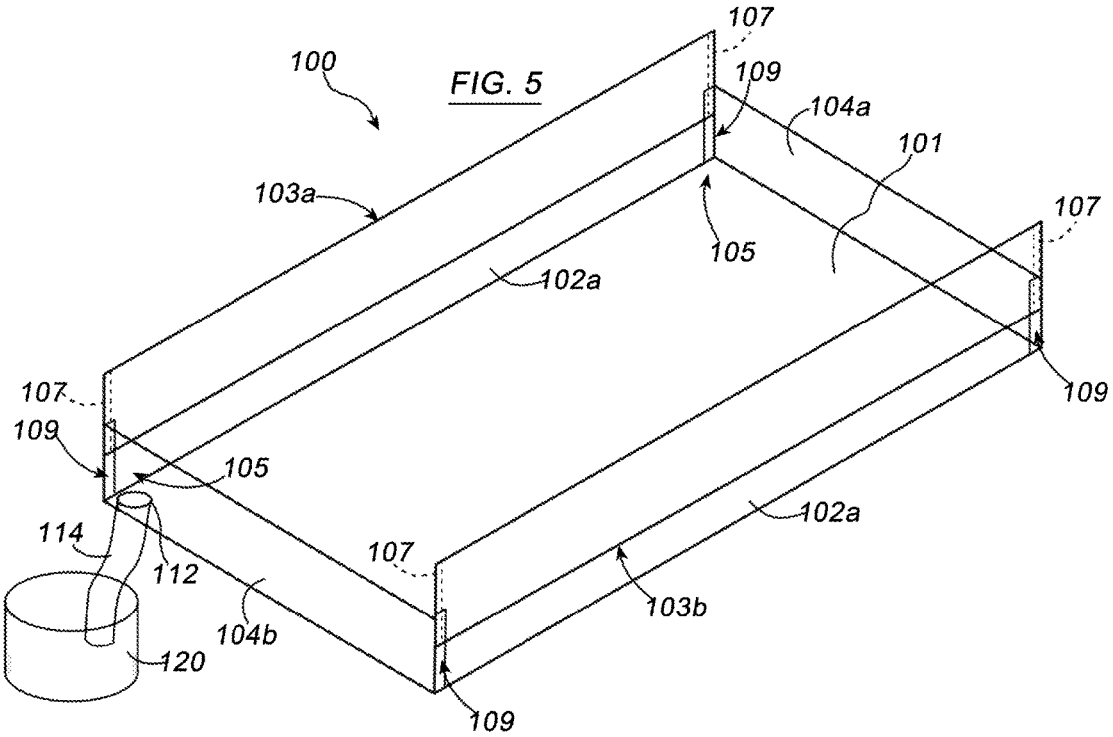
FIG. 5 is a isometric view of the embodiment of (FIGS. 1-4), which for for purposes of clarity is depicted in a raised state without the ordinarily supporting structure of a hospital-style bed, wherein side panels 102*a*, 102*b* are conjoined respectively at corners 105 by seams 109 to end panels 104*a*, 104*b;*

FIG. 5 depicts an embodiment with end panels 104*a*, 104*b* transversely supported between side panels 102*a*, 102*b*, and side panels conjoined to end panels at seam 109. In the particular embodiment depicted, dashed lines indicate a seal 107 at the inner terminus of pockets 103*a*, 103*b*. Drain 112 and drain tube 114 are located at a corner 105 of the erected enclosure. Although in the particular embodiments depicted herein a single drain is shown in a corner 105, more than one drain can be included in the bed bath article.

Figure 6:
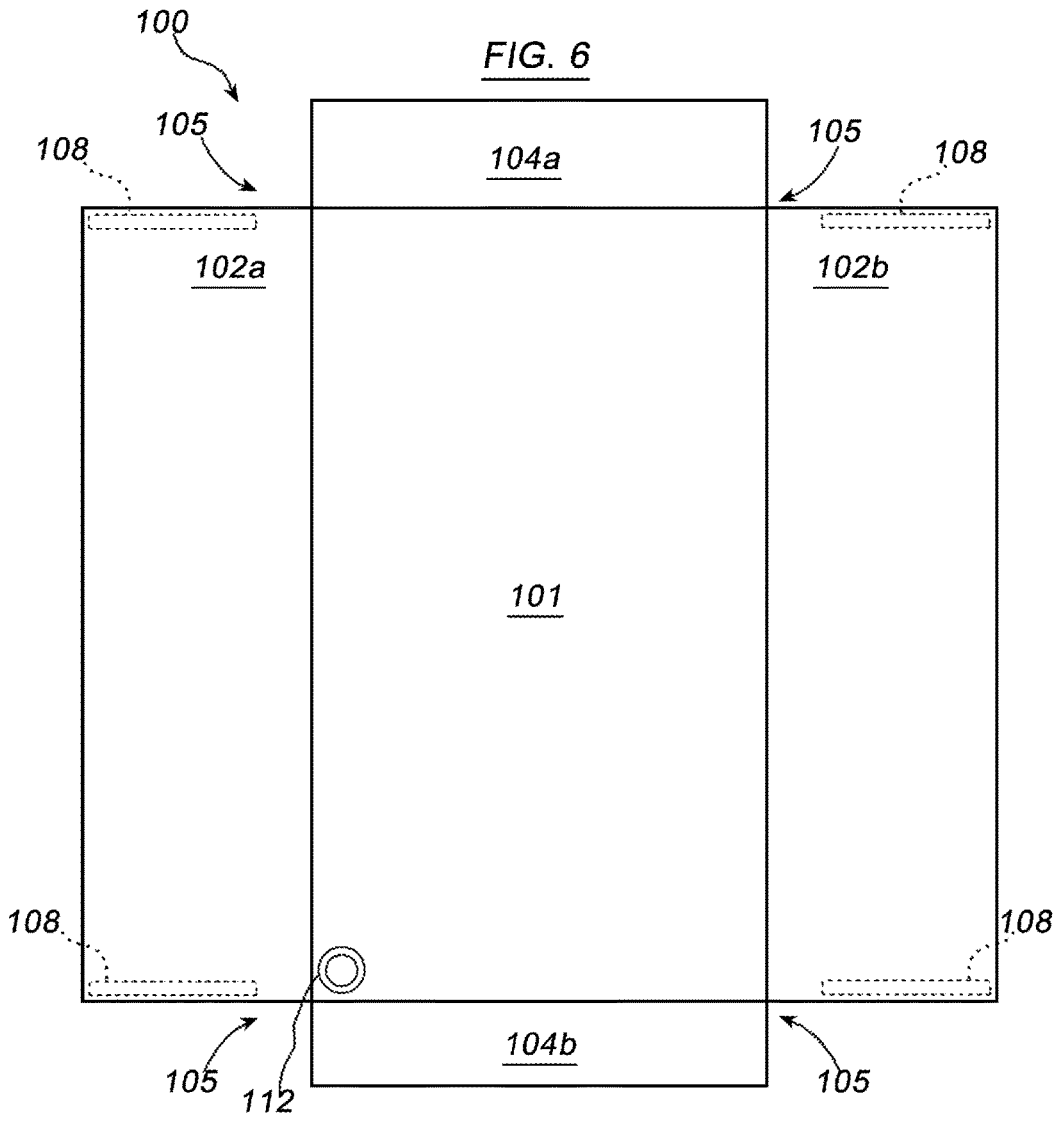
FIG. 6 is a plan view of a second embodiment having adhesive strips 108 on the side panels for creating ad hoc pocket structures within side panels 102*a*, 102*b;*

FIG. 6 is a plan view depicting another embodiment having strips 108 of light-tack non-residue producing adhesive on side flap 110 portions of the side panels 102*a*, 102*b*. One adhesive film employing a non-residue producing adhesive layer is SmartFilm™ Surface Barrier which is a temporary and easily removable infection control barrier for medical equipment. Accordingly, each side panel may be folded against itself where portions of the side panel having the light-tack adhesive indicated by dashed line demarcated regions 108 are adhered to portions of the side panel lacking the adhesive producing a "pocket" where the location of the folding line 106 determines pocket depth. A pocket of a required depth may be produced in this manner, or the side panels may be placed over and adhered directly to the bed side rails. Adhesive strips 108 may include a peel away backing to prevent accidental adhesion. End panels 104*a*, 104*b* may also include light-tack adhesive strip(s) for attachment to portions of the bed; e.g., footboard or headboard.

Figure 7:
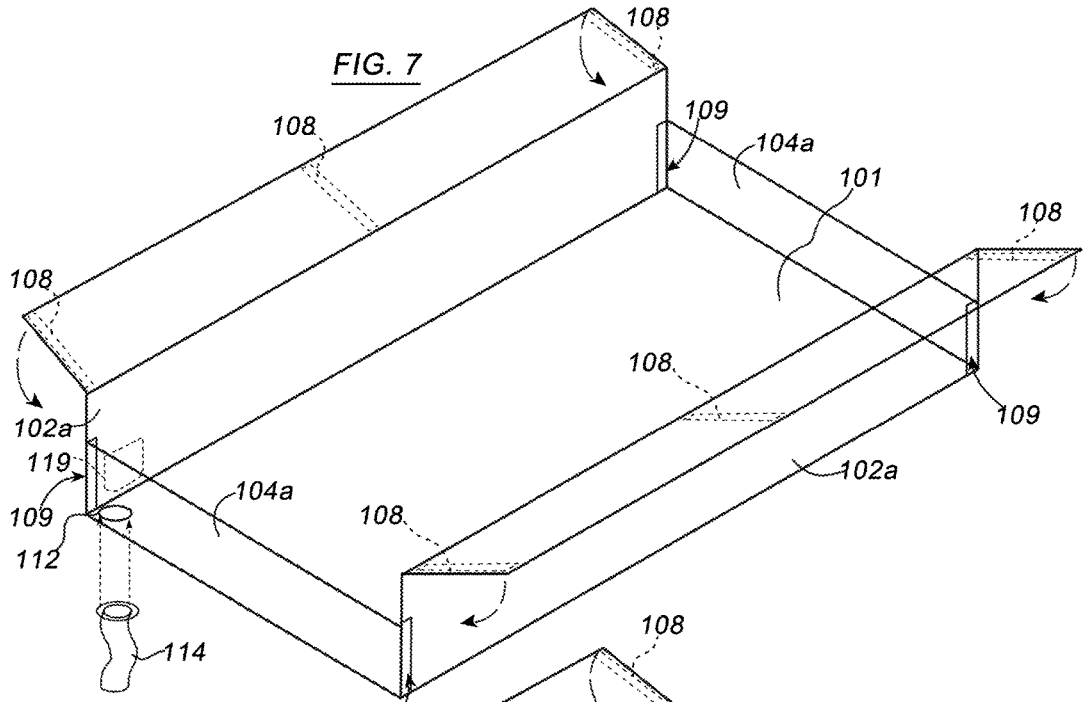
FIG. 7 is an isometric view of the embodiment of (FIG. 6) which for purposes of structural clarity is depicted in a raised state without the ordinarily supporting structure of a hospital-style bed, and, wherein side panels 102*a*, 102*b* are conjoined at corners 105 by seams 109 to end panels 104*a*, 104*b;*
Figure 8:
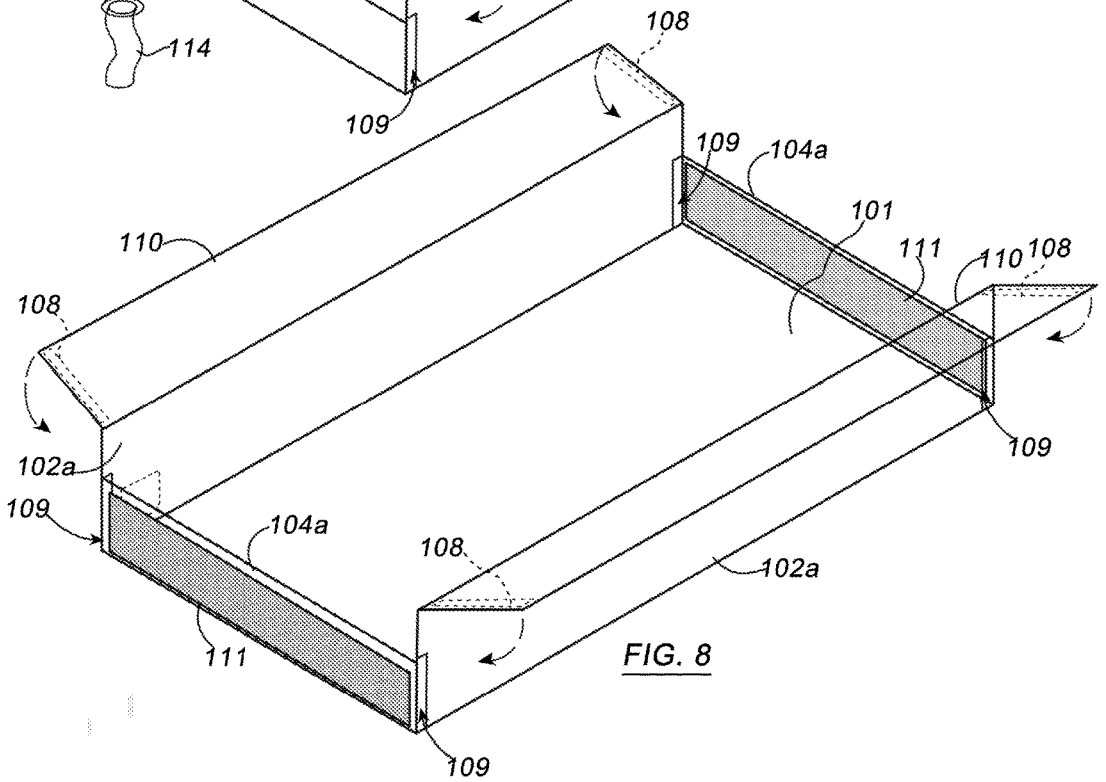
FIG. 8 is an isometric view of another where stiffeners 111 have been added to end panels 104*a*, 104*b;*

While typically plastic end panels 104*a*, 104*b* having a thickness of 8 mil will support themselves without collapsing when supported between side panels 102*a*, 102*b*, plastic film of lesser thickness may require additional support. FIG. 7 is an isometric depiction of another embodiment similar to that shown in (FIG. 6) where a stiffener 111 is adhered to portions of end panels 104*a*, 104*b*.

Figure 9:
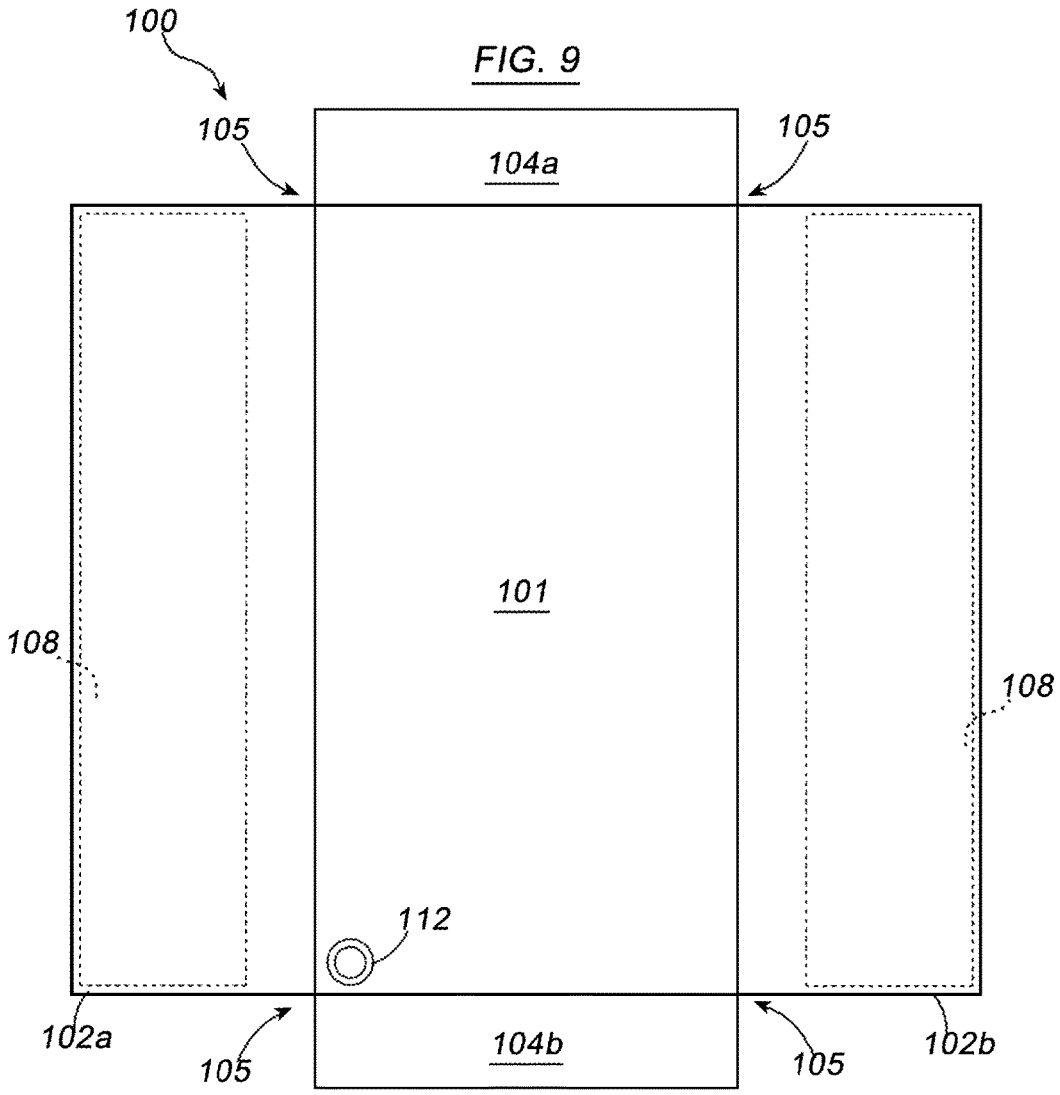
FIG. 9 is a plan view of an embodiment having a relatively large adhesive strip 108 on side panels 102*a*, 102*b;*

FIG. 9 is a plan view of an embodiment similar to that shown in (FIG. 6), where side panels include a large adhesive strip 108 on the underside of the panels, that may be adhered to itself, or portions of a hospital-style bed; e.g., bed side rails.

Figure 10:
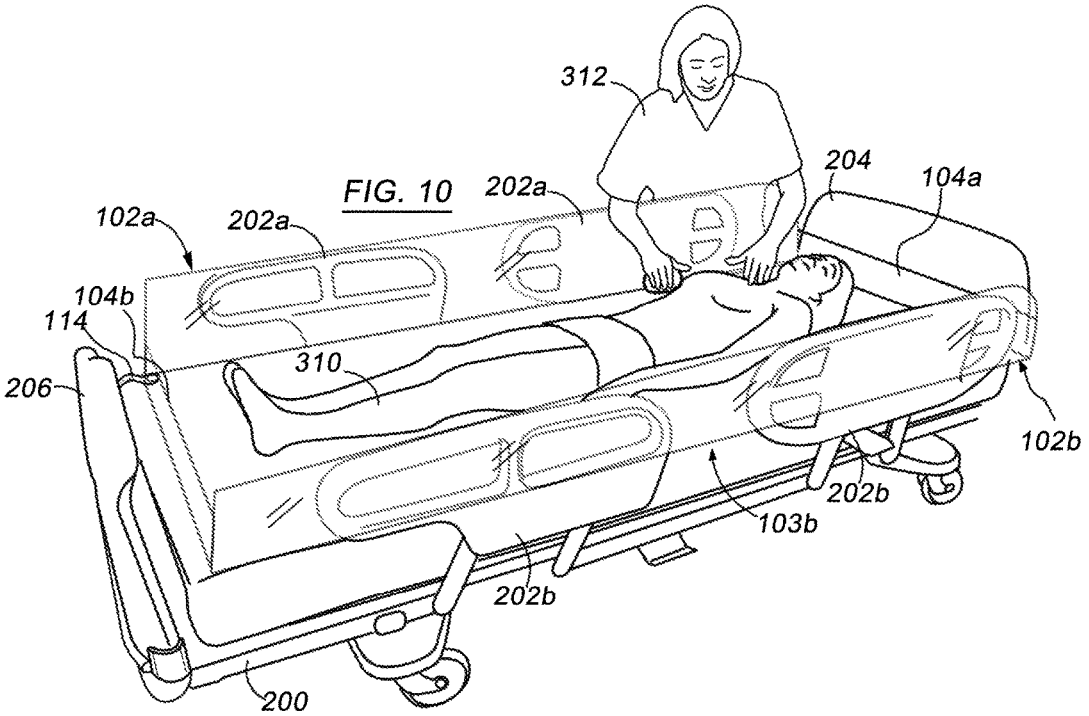
FIG. 10 illustrates a general embodiment according to the present invention in an exemplary environmental setting.

FIG. 10 illustrates a general embodiment of a bed bath article 100 installed on a hospital-style bed with side panels 102*a*, 102*b* supported by side rails 202*a*, 202*b*. Bottom panel 101 of the bed bath article is configured to span mattress 208 in all directions. Side panels 102*a*, 102*b* may be disposed parallel to one another in the configuration shown, or may cant outwardly. Likewise, end panels 104*a*, 104*b* may be disposed parallel to one another, or may cant outwardly. Pockets 103*a*, 103*b* may extend the entire length of the corresponding side panel, or may occupy only a portion of the side panel length. Drain tube 114 is typically flexible and foldable, and located at a corner of the article to provide the most efficient evacuation of the waste water.

When side panels 102*a*, 102*b* are supported by the side rails 202*a*, 202*b* the structure of the enclosure is stabilized and will not collapse during use. Once patient 310 is positioned atop bottom panel 101, the bathing procedure can begin. As water and debris are rinsed from the patient, waste water is drawn by gravity into drain 112 through attached drain tube 114 and into waste receptacle 120. Drain tube 114 may be a lay-flat type hose which is normally packed in a flattened state and expands with flowing liquid. Such lay-flat hoses may be wholly or partially kinked or folded as required to control the wastewater flow. Alternately, the drain tube may be secured with a clip, a rubber band or other suitable means for securing the tube in a kinked or folded disposition. The drain tube may be secured out of the way by tucking or folding it into a pocketed pouch 119 located on a side or underside of the article. By controlling wastewater flow, the bathing procedure can include periods of rinsing and soaking according to patient need.

When installing the bed bath article, the article is placed on the bed 200 next to and aligned with a reclined patient. First, the patient is rolled onto his or her side with the front of his or her body facing and substantially parallel to one set of side safety rails 202*a*, 202*b*. Article 100 is unfolded making sure that drain 114 placed at the footboard 206 end of the bed and with the corner drain 112 slightly below the plane of the mattress 208. Beginning behind the patient, a first side panel; either 102*a* or 102*b* is pushed against the bed mattress and as far as possible under the patient's body. The patient is then rolled onto the article and into a position facing the bed side rail opposite the first. The first side panel beneath the patient is freed and suspended from the nearest bed side rail. The foregoing steps are repeated, first one side and then the other, until the patient is lying on the bottom panel 101 between erected and supported side panels 102*a*, 102*b*. If the patient has some mobility, he or she can assist the care provider by using the bed side rails as hand grips. The end panels 104*a*, 104*b* are either held taut and upright by the supported side panels, or, the end panels may be attached to the headboard or footboard of the bed. Once the patient has been bathed, the article is drained of water and debris and removed by following the described steps in reverse.

Figure 11:
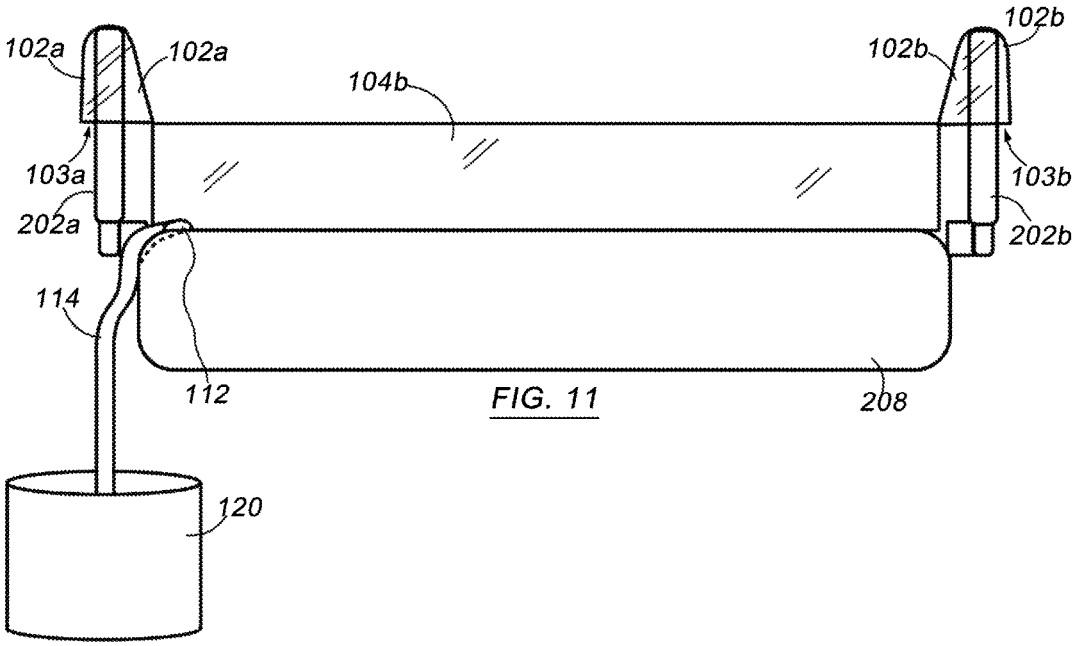
FIG. 11 is a partial view of an end of a hospital-style bed with bed bath article installed.
Figure 12:
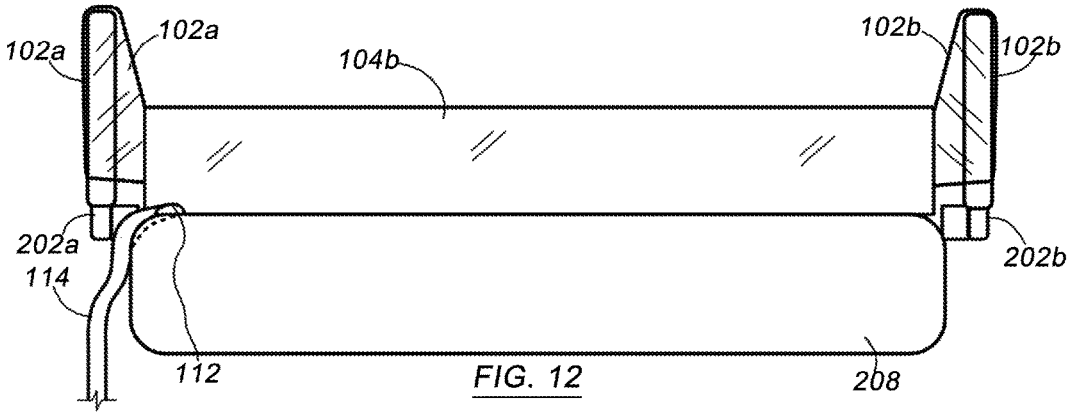
FIGS. 12-14 are partial views showing end panels 104*a*, 104*b* place over various common hospital bed side rail configurations, while (FIG. 14) in particular, shows the application of a stiffener 111, to either an outer surface of end panel 104*b*, or a pocket within end panel 104*b;*
Figure 13:
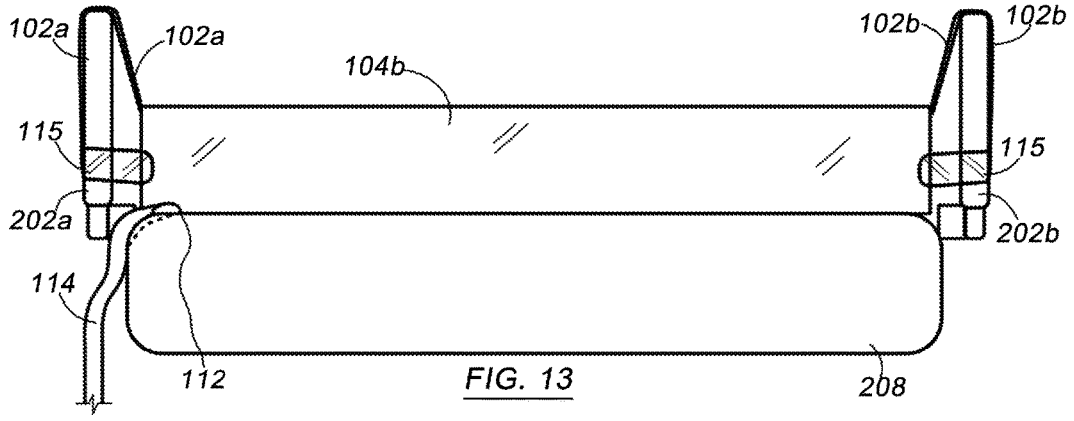
Figure 14:
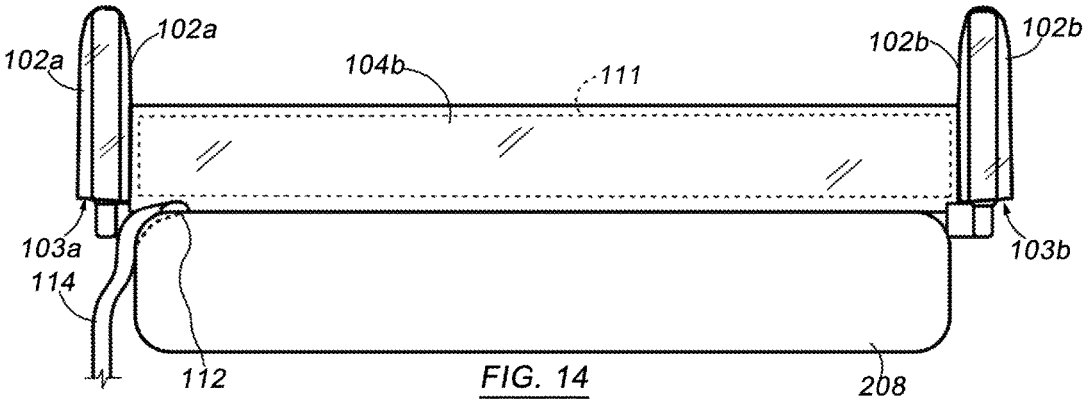

FIG. 11 is a partial view showing an end of a bed 200 and bed bath article 100 with the bed footboard purposely omitted to better illustrate the relationship of the article to the bed structure. FIGS. 12-14 are partial views showing various configurations of joins between the side panels and the end panels. FIGS. 12 and 13 show an end panel supported tautly between side panels that are covering over portions of hospital-style side rails. FIG. 14 shows end panel 104*b* with a stiffener 111 that may be applied to the outside face of the end panel. While a stiffener may or may not be required based on the particular configuration of the hospital-style bed, one or more small folded section(s) of cardboard or other suitable article with or without a peel-away adhesive backing may be included with the bed bath article, and adapted to adhere to the outside surface of an end panel, or be inserted into a cavity of an end panel.

Figure 15:
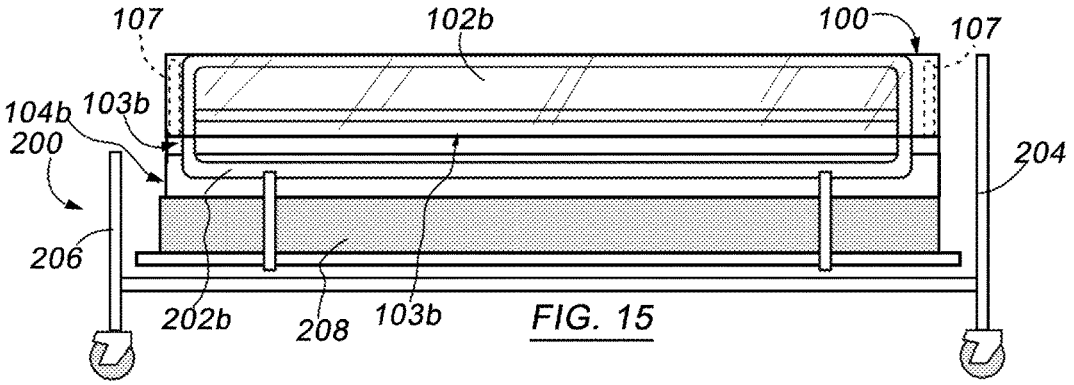
FIGS. 15-17 show side panels 102*a*, 102*b* place over various common hospital bed side rail configurations, where in some cases a single pocket is between pocket seals 107, (FIG. 15), while in (FIGS. 16-17), one or more pockets are formed between portions of the hospital-style bed side rails.
Figure 16:
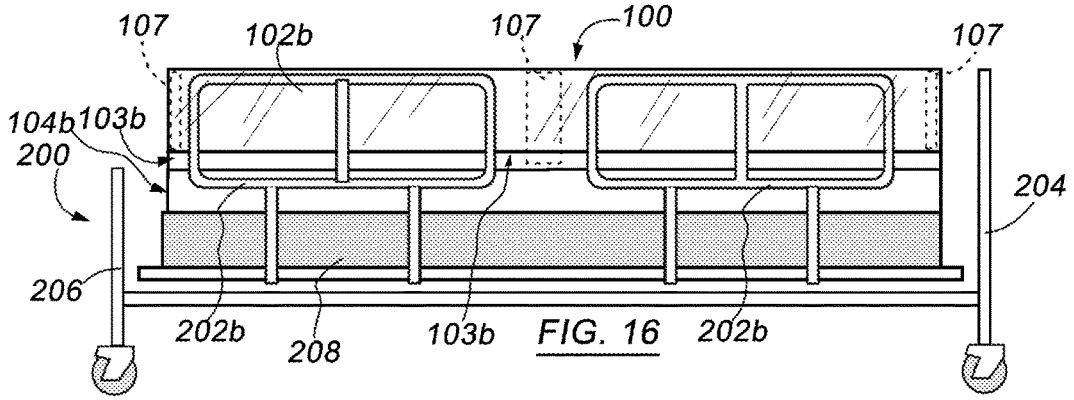
Figure 17:
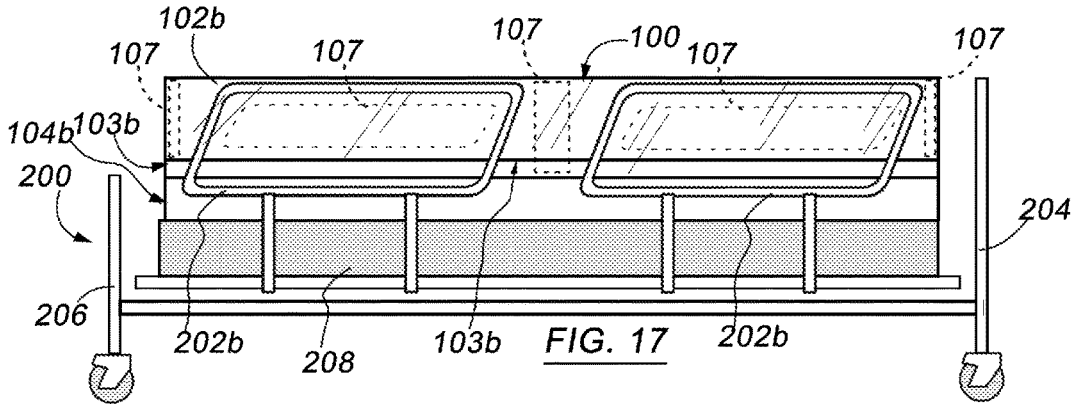
Figure 18:
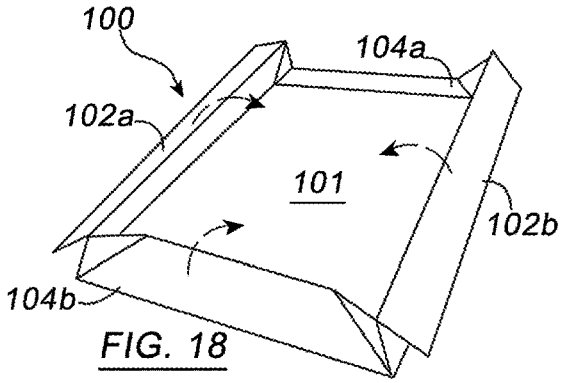
FIGS. 18-24 in a series of progressive views, depict an exemplary folding configuration for the bed bath article into a compact package.
Figure 19:
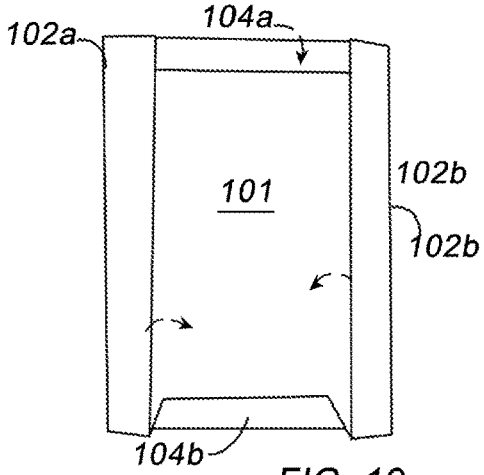
Figure 20:
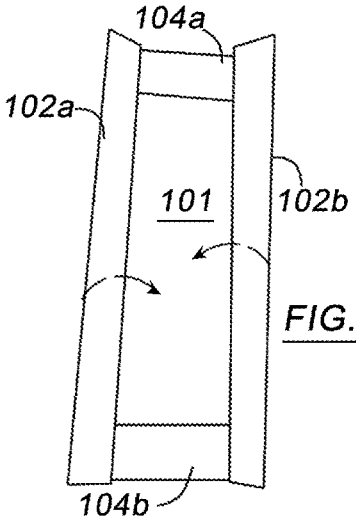
Figure 21:
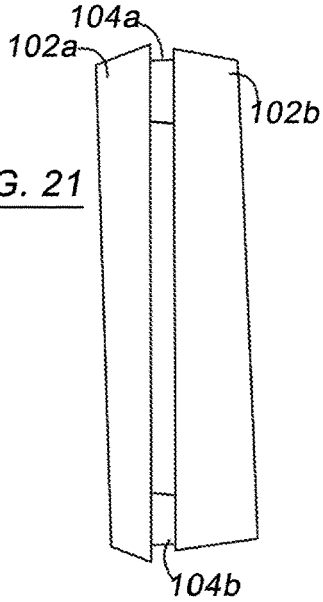
Figure 22:
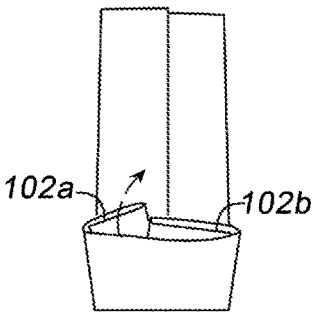
Figure 23:
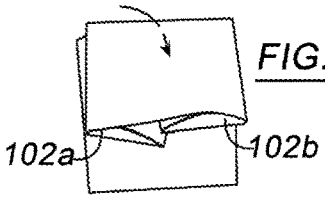
Figure 24:
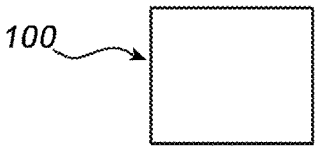
Figure 25:
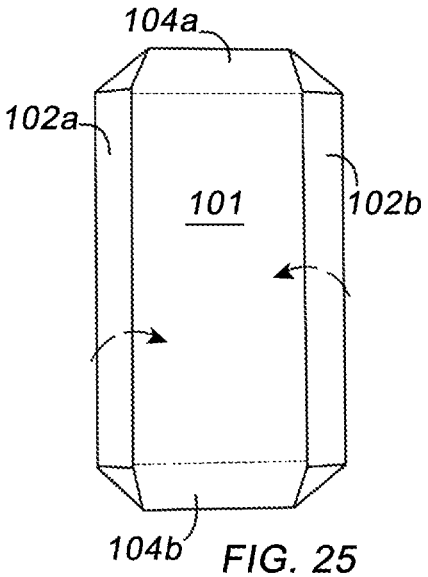
FIGS. 25-29 in a series of progressive views, depict another exemplary folding configuration to produce a small package.
Figure 26:
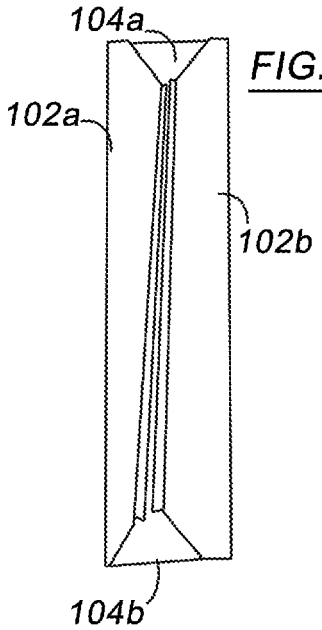
Figure 27:
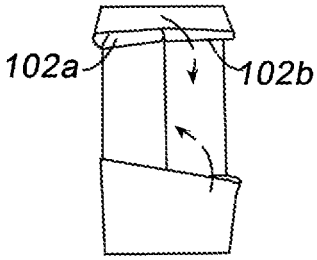
Figure 28:
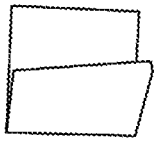
Figure 29:
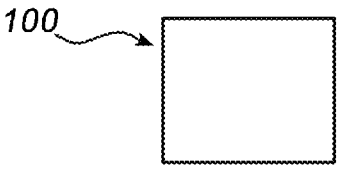

FIGS. 15-17 show side rails installed over portions of a variety of hospital-style bed side rail configurations. The dashed lines indicate pocket boundaries, or an area of a side panels adhered to itself either circumjacent the bed side rails or between portions of the bed side rails.

Folding and Packaging of the Article

Referring generally to FIGS. 18-29, in a series of progressive views, the bed bath article 100 is folded and compactly packaged according to the accompanying directional arrows, in order to enable a single provider to install and manage the article. The particular folding shown is merely exemplary. Other folding methods will suggest themselves to those having skill in the art and benefit of this disclosure.

The bed bath article of the present invention can be used in nursing homes, acute or chronic care hospitals, or other facilities for a series of patients where standard hospital bed with side safety rails are utilized. The article may also be ideally used in a manner consistent with decontaminating a patient who has been exposed to chemical, radiologic, or pathologic hazards. In such cases, the device can serve as a decontamination unit. The article may be provided in different sizes for large adults, smaller adults, and children. The device may be manufactured in an variety of colors whereby color may serve to designate a patient's condition, such as "high fall risk" or "isolation" due to a contagion or illness. Such colors may also serve to designate the size of the device, where by one color may designate a particular size of the patient who is to be bathed.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

I claim:

1. A bed bath article for bathing a bed bound person comprising:

(1) a foldable water impervious construction configured to be placed under a bed bound person while in a partially folded or collapsed configuration without requiring lifting of the person, the construction including:

(a) a substantially rectangular bottom panel including two long borders and two short borders;

(b) at least two side panels, each side panel is joined along a long border of the bottom panel, each side panel includes a length and a height, and each side panel is configured to form a pocket along the entire length of each side panel, the pocket includes ends adapted for closure, the pocket includes an opening adapted to extend substantially along the length of the side panel in a direction facing the long border of the bottom panel along which the side panel is joined, and the pocket opening is adapted to admit an entire side rail of a hospital-style bed, and, (c) at least two end panels joined at the short borders, each end panel including an inner face and an outer face and a top edge, the at least two side panels and the at least two end panels are conjoined angularly at corners to form a water tight bathing enclosure for a patient such that the inner and outer faces and the top edge of the end panels are configured for frameless support wherein the end panels are tensionably supportable in an upright position between the side panels without otherwise requiring support when the pockets of the side panels are supported by the side rails of a hospital-style bed; and, (d) a drain and drain tube to drain the enclosure of fluid.

2. The bed bath article according to claim 1, wherein side panels of the least two side panels are opposite one another.

3. The bed bath article according to claim 1, wherein end panels of the least two end panels are opposite one another.

4. The at least two side panels according to claim 1 configured to cover portions of side rails of a hospital-style bed.

5. The bed bath article according to claim 1 wherein the at least two end panels are self supporting.

6. The at least two side panels according to claim 1 further comprising a light-tack adhesive configured for adhering to portions of a hospital-style bed.

7. The bed bath article according to claim 1 wherein the construction includes pliant material of at least 5 mil thickness.

8. The bed bath article according to claim 1 wherein the drain tube packs flat.

9. The bed bath article according to claim 1 further comprising a pouch located on the article for storing the drain tube.

10. The bed bath article according to claim 1 further comprising a receptacle for wastewater.

11. A bed bath article for a bed bound person comprising:

(1) a foldable water impervious construction configured to be placed under a person resting on a bed without requiring lifting of the person, including:

a substantially rectangular bottom panel with borders;

at least two side panels, each side panel includes a join along an opposite long border of the bottom panel, each side panel includes a length and a height, and each side panel is configured to form a pocket that includes a lengthwise opening facing the join, the pocket includes a flap which is adapted to temporarily adhere to itself and portions of a side rail of a hospital-style bed and thereby form a readily removable enclosure for portions of a side rail of a hospital-style bed with bed side rail attachment members;

at least two end panels, each end panel is joined along an opposite short border of the bottom panel, each end panel includes: a length and a height, two ends and a top edge;

the at least two side panels and the at least two end panels are joined angularly at corners to form a water tight bathing enclosure for a patient, the height of the side panels exceeds the height of the end panels and the end panels are configured for frameless and tensionable upright support between the side panels when the side panels are supported by the side rails of a hospital-style bed; and, a drain and drain tube to drain the enclosure of fluid.

12. The bed bath article according to claim 11, wherein side panels of the least two side panels are opposite one another.

13. The bed bath article according to claim 11, wherein end panels of the least two end panels are opposite one another.

14. The at least two side panels according to claim 11 configured to cover portions of side rails of a hospital-style bed.

15. The bed bath article according to claim 11 wherein the at least two end panels are supported in an upright position between the at least two side panels.

16. The at least two side panels according to claim 11 further comprising a light-tack adhesive configured for adhering to portions of a hospital-style bed.

17. The bed bath article according to claim 11 wherein the panels are capable of being folded under a mattress between the mattress and bed frame.

18. A method for providing a bed bath to a bed bound person comprising the steps of:

providing a water tight foldable plastic enclosure comprising:

a bottom panel, two side panels conjoined to the bottom panel wherein each side panel includes a length and a height, two end panels conjoined to the bottom panel wherein each end panel includes a length and a height less than the side panels, the end panels and side panels conjoined angularly at corners and wherein the end panels are configured for frameless tensionable upright support between the side panels by the conjoined corners when the side panels are supported by the side rails of a hospital-style bed and wherein the end panels require no other support structure, and, each side panel includes a pocket with a longitudinal opening in the direction of the bottom panel and each pocket includes opposing surfaces configured to temporarily adhere to one other and portions of a bed side rail of a hospital-style bed, and a drain exiting the bottom panel;

positioning the bottom of the enclosure beneath the bed bound person without lifting the person;

erecting the side panels by encapsulating portions of the bed side rails within the side panel attachment portions, and tensioning the end panels between the side panels;

bathing the patient;

draining the enclosure of wastewater; and, detaching each side panel from the encapsulated bed side rail.

19. The method according to claim 18 further comprising the step of removing or discarding the enclosure.

* * * * *